US010987698B2

(12) United States Patent
Currey

(10) Patent No.: US 10,987,698 B2
(45) **Date of Patent: *Apr. 27, 2021**

(54) HYDRAULIC VIBRATION GENERATING DEVICE

(71) Applicant: Albert Ben Currey, Phoenix, AZ (US)

(72) Inventor: Albert Ben Currey, Phoenix, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/802,851

(22) Filed: Feb. 27, 2020

(65) Prior Publication Data

US 2021/0060614 A1 Mar. 4, 2021

Related U.S. Application Data

(63) Continuation of application No. 16/553,088, filed on Aug. 27, 2019, now Pat. No. 10,610,896.

(51) Int. Cl.
*B06B 1/18* (2006.01)

(52) U.S. Cl.
CPC ..... *B06B 1/186* (2013.01)

(58) Field of Classification Search
CPC ..... B06B 1/186
USPC ..... 366/124–126
See application file for complete search history.

(56) References Cited

U.S. PATENT DOCUMENTS

| | | | |
|---|---|---|---|
| 2,970,570 | A | 2/1961 | Hill |
| 3,866,480 | A | 2/1975 | Elliston |
| 4,472,980 | A | 9/1984 | Wadensten |
| 4,590,814 | A | 5/1986 | Wadensten |
| 5,314,305 | A | 5/1994 | Fink |
| 6,244,815 | B1 | 6/2001 | Treat |
| 2018/0292501 | A1 | 10/2018 | Neumann et al. |

*Primary Examiner* — Justin D Seabe
(74) *Attorney, Agent, or Firm* — Schmeiser, Olsen & Watts LLP

(57) ABSTRACT

A hydraulic vibration generation device is provided. The device includes a manifold member having an inner volume, a fluid inlet orifice and a fluid outlet orifice. The device further includes a vibration generating member having a channel grooved drive and an off-center weight, and bearing retaining plates. The inner volume receives the vibration generating member within the inner volume. The bearing retaining plate that retain bearings operate to retain the vibration generating member within the inner volume in response to coupling the bearing retaining plate to the manifold member wherein two bearings on opposing ends of the vibration generating member are retained within recesses of the bearing retaining plates. The vibration generating member rotates and generates vibration in response to hydraulic fluid flowing into the manifold member through the inlet orifice and out of the manifold member through the outlet orifice.

8 Claims, 8 Drawing Sheets

HYDRAULIC VIBRATION GENERATING DEVICE

CROSS REFERENCE TO RELATED APPLICATION[S]

This application is a continuation of the earlier U.S. Utility patent application Ser. No. 16/553,088, filed Aug. 27, 2019, the disclosure of which is hereby incorporated entirely herein by reference.

BACKGROUND OF THE INVENTION

Technical Field

This invention relates generally to vibration generating device, and more particularly to a hydraulic driven vibration generating device that can be very small or very large, under high pressure hydraulics within a pressure range of 0-6000 psi, which is not available today.

State of the Art

There are several material processing products that utilize vibration during operation, such as, but not limited to screening of material implementations. Other devices also utilize vibratory devices in the operation and utilization. These devices are generally electromechanical or mechanical system. They include gears and other components that are prone to failure.

Therefore, there is a need for an improved vibration generating device that is not electromechanical or mechanical and has greater durability than conventional vibratory devices.

SUMMARY OF THE INVENTION

The present invention relates to a hydraulic driven vibration generating device comprising: a manifold member comprising an inner volume, a fluid inlet orifice and a fluid outlet orifice; a vibration generating member comprising a channel grooved drive and an off-center weight; two bearings operatively coupled to opposing ends of the vibration generating member; and two bearing retaining plates, wherein: the inner volume receives the vibration generating member within the inner volume; the bearing retaining plates retain the vibration generating member within the inner volume in response to coupling the bearing retaining plates to opposing ends of the manifold member; and the vibration generating member rotates and generates vibration in response to hydraulic fluid flowing into the inner volume of the manifold member through the inlet orifice, engaging the channel grooved drive and out of the inner volume of the manifold member through the outlet orifice.

The foregoing and other features and advantages of the present invention will be apparent from the following more detailed description of the particular embodiments of the invention, as illustrated in the accompanying drawings.

BRIEF DESCRIPTION OF THE DRAWINGS

A more complete understanding of the present invention may be derived by referring to the detailed description and claims when considered in connection with the Figures, wherein like reference numbers refer to similar items throughout the Figures, and:

DETAILED DESCRIPTION OF EMBODIMENTS OF THE INVENTION

Figure 1:
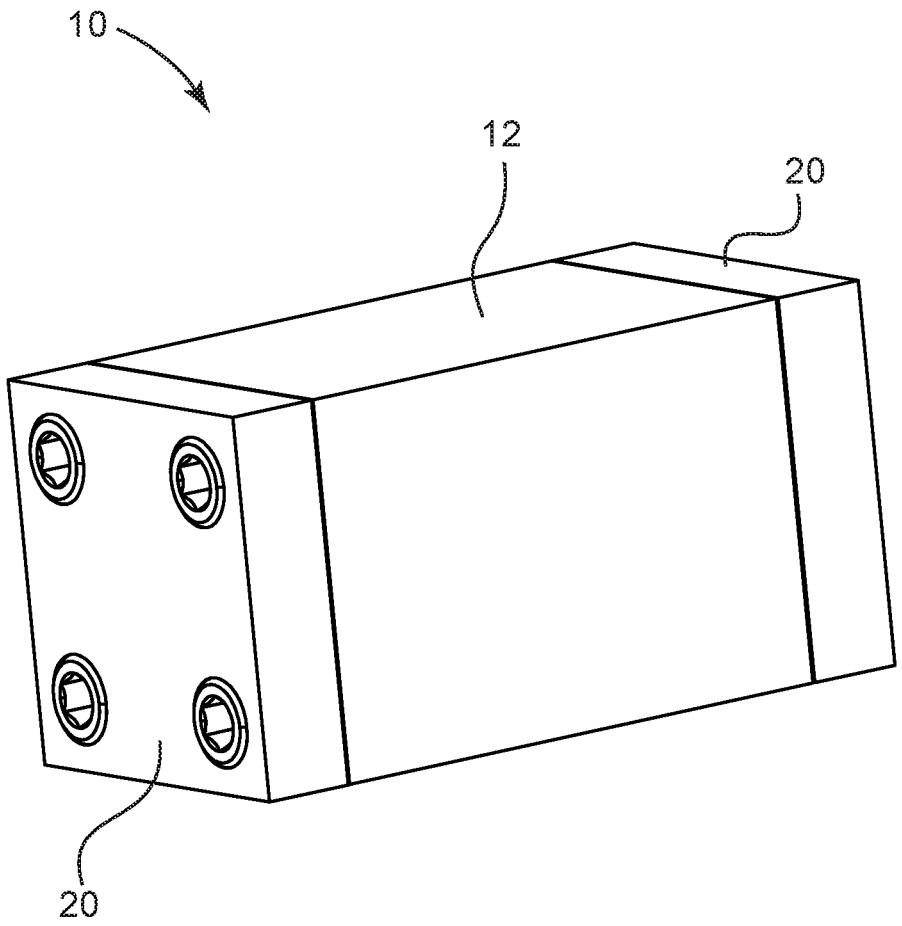
FIG. 1 is a perspective view of a hydraulic vibration generating device according to an embodiment.
Figure 2:
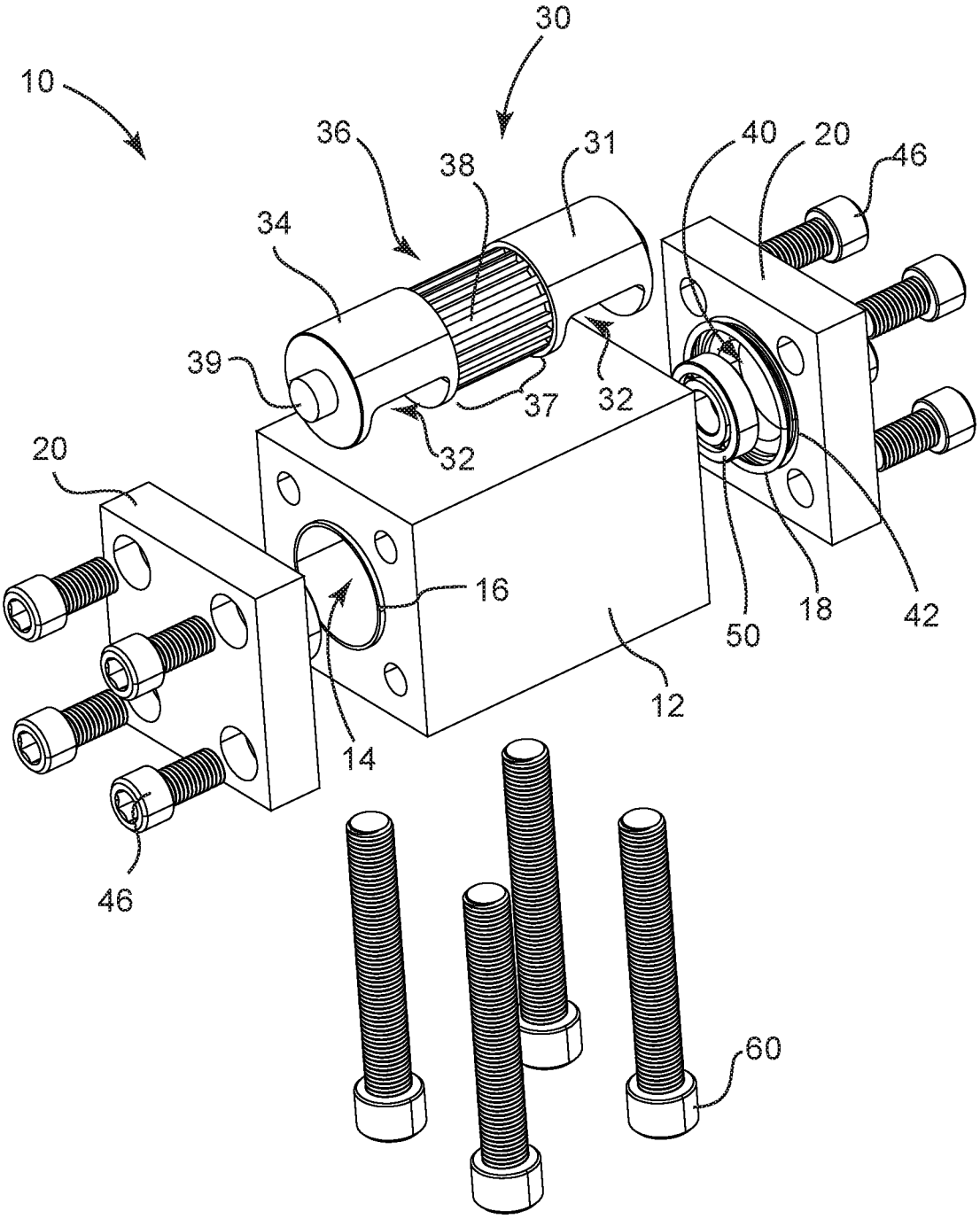
FIG. 2 is a perspective exploded view of a hydraulic vibration generating device according to an embodiment.
Figure 3:
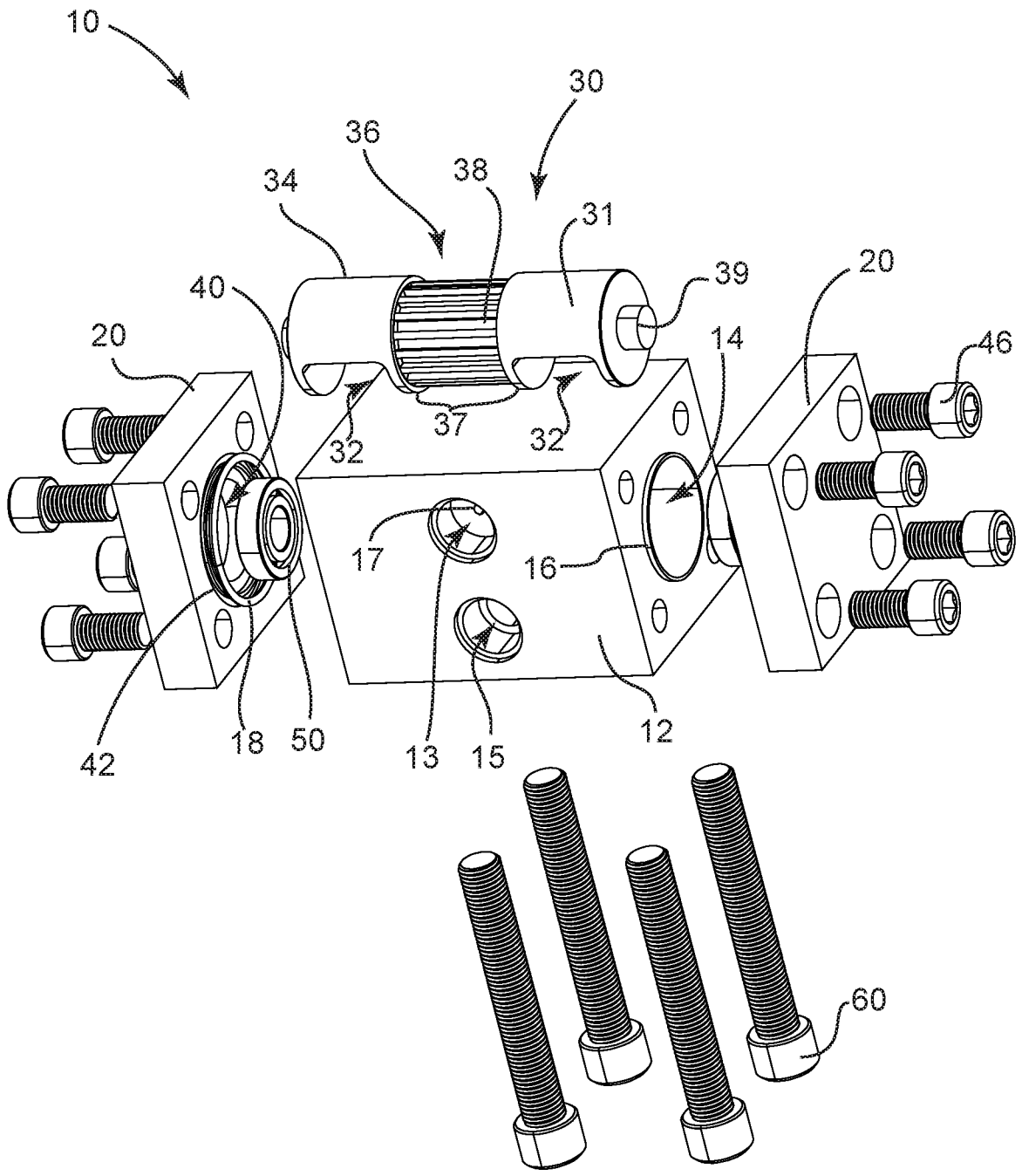
FIG. 3 is a perspective exploded view of a hydraulic vibration generating device according to an embodiment.
Figure 4:
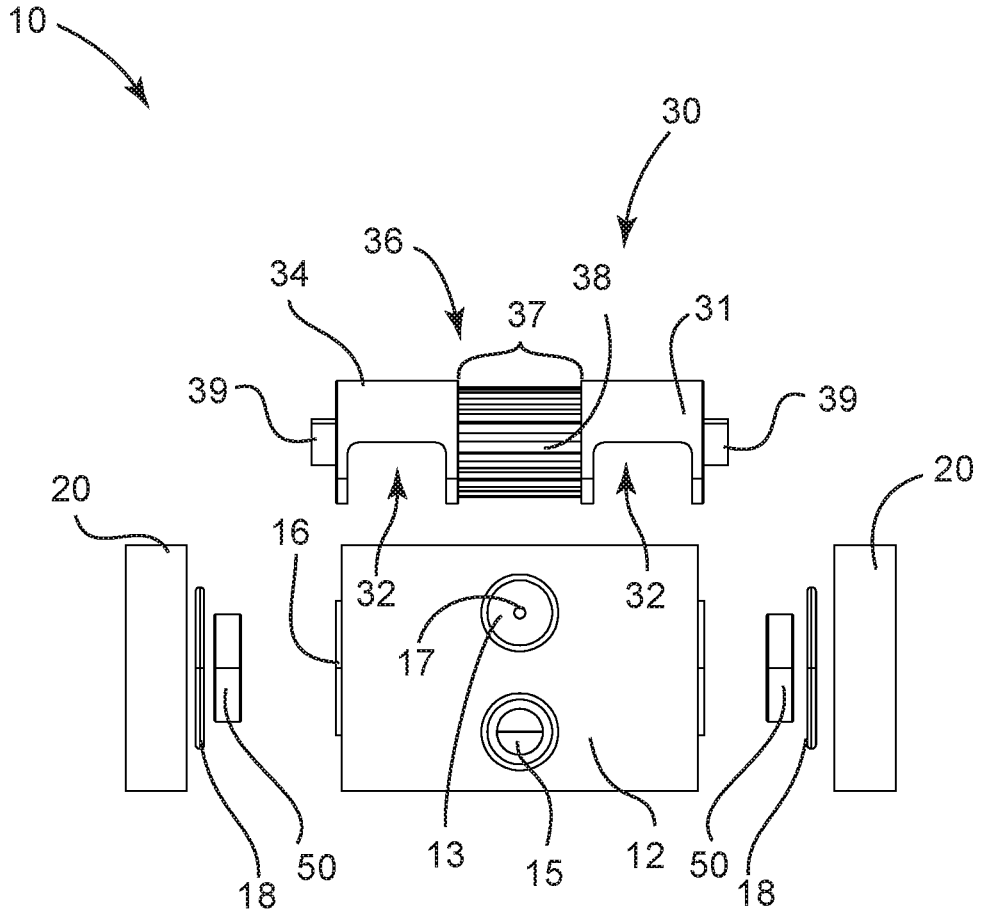
FIG. 4 is a side exploded view of a hydraulic vibration generating device according to an embodiment.
Figure 5:
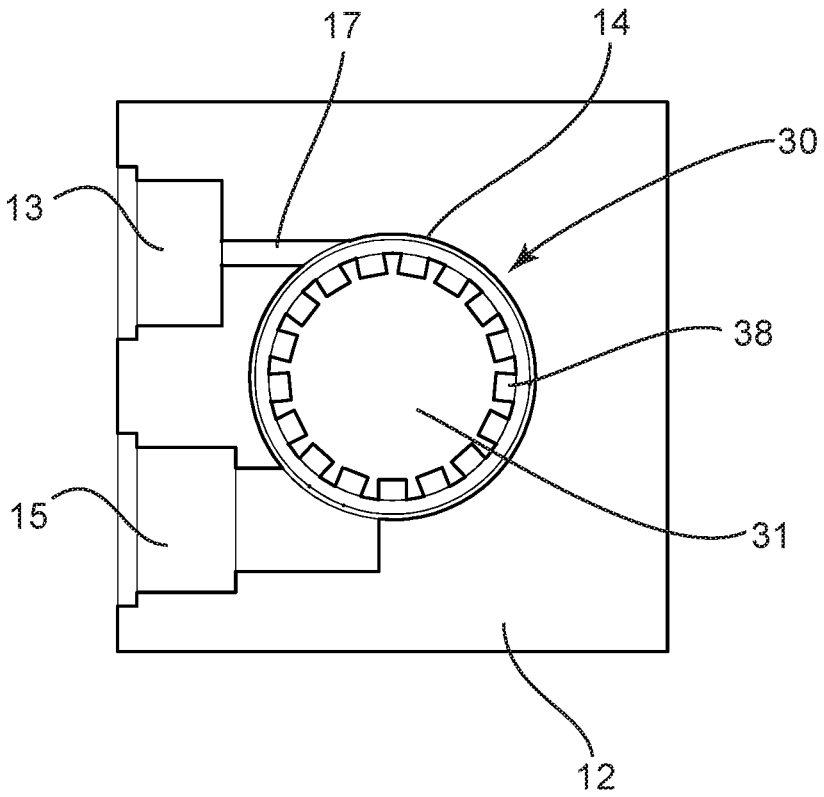
FIG. 5 is a section view of a hydraulic vibration generating device according to an embodiment.
Figure 6:
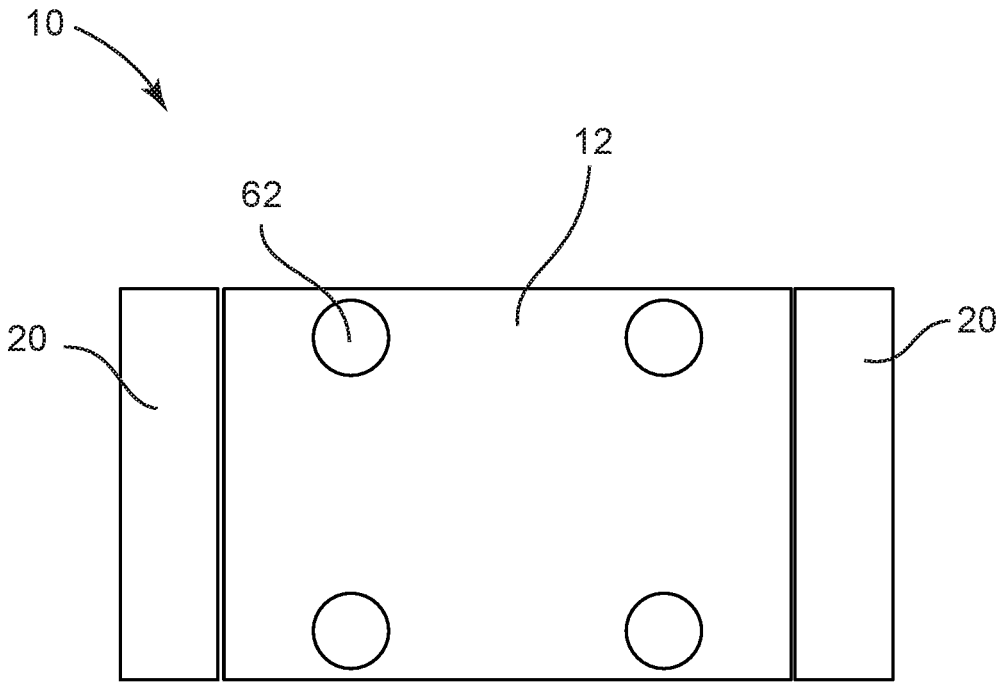
FIG. 6 is a bottom view of a hydraulic vibration generating device according to an embodiment.
Figure 7:
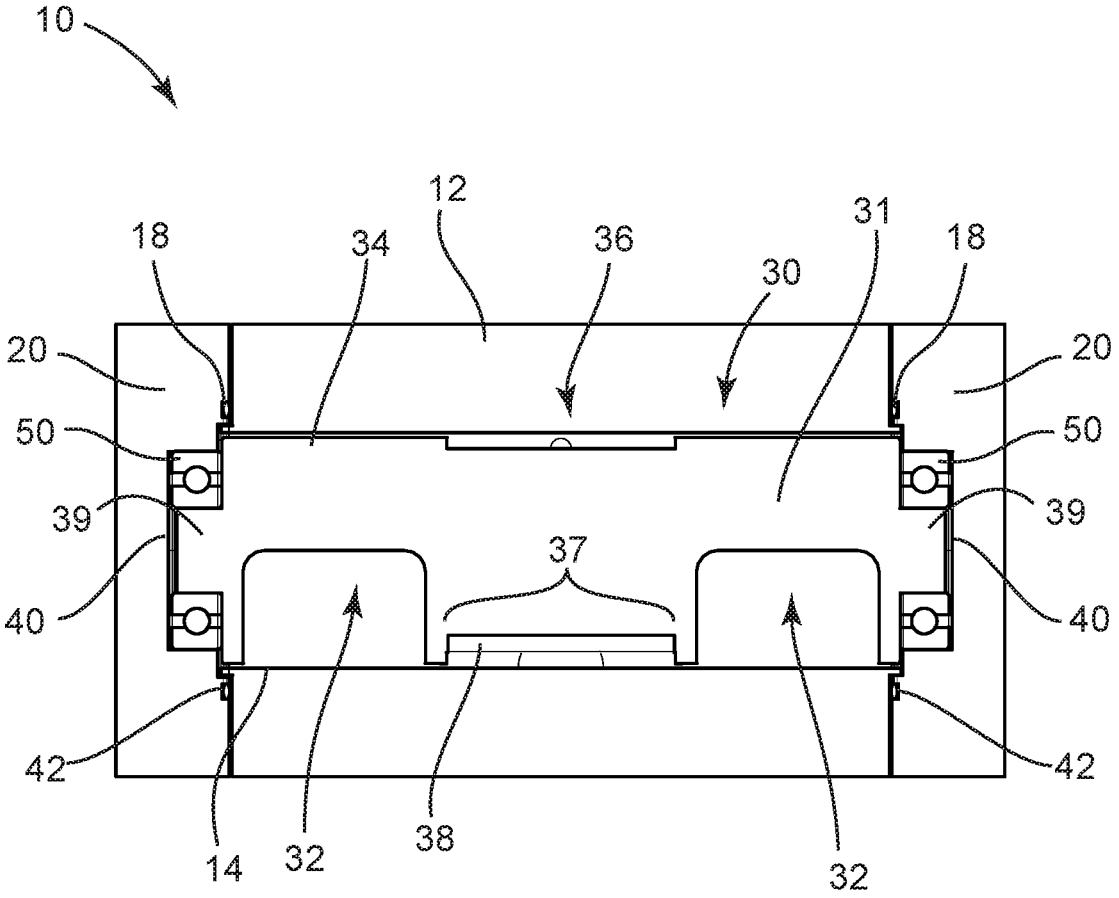
FIG. 7 is side section view of a hydraulic vibration generating device according to an embodiment.

As discussed above, embodiments of the present invention relate to a hydraulic driven vibration generating device.

Referring to the drawings, FIGS. 1-8 depict an embodiment of a hydraulic driven vibration generating device 10. The device 10 generally comprises a manifold member 12, bearing retaining plates 20, and a vibration generating member 30, wherein the vibration generating member 30 is retained within the manifold member 12 by coupling the bearing retaining plates 20 to the manifold member 12.

The manifold member 12 may be a block shape or other shape that is needed for the operation of the vibration generating device 10. The manifold member 12 may comprise an inner volume 14 that may be an aperture extending through the manifold member 12, wherein the aperture 14 may be bounded on each end by coupling the bearing retaining plates 20 on opposing side of the manifold member 12. In embodiments, the inner volume 14 is a cylindrical shape. The manifold member 12 may also comprise an inlet orifice 13 and an outlet orifice 15. This allows hydraulic fluid to flow into the manifold member 12 through the inlet orifice 13 and into the inner volume 14 to engage and rotate the vibration generating member 30, and then out through the outlet orifice 15. The outlet orifice 15 has a larger opening to the inner volume 14 than the inlet orifice 13 in order to remove fluid from the inner volume as quickly as possible. An inlet hose adapter (not shown) may be coupled between the inlet orifice 13 and an inlet hose and an outlet hose adapter (not shown) may be coupled between the outlet orifice 15 and an outlet hose, thereby allowing a fluid inlet hose and a fluid outlet hose to be coupled to the manifold member 12 for operation of the device 10. The inlet orifice 13 and the outlet orifice 15 may be at any angle through the manifold member 12 to accomplish the flow of hydraulic fluid into and out of the manifold member 12. As will be understood hydraulic fluid may comprise, but is not limited to, gas, air, oil, water and the like fluids that can be flowed through the system and operate the vibration generating device 10.

In embodiments, the vibration generating device 10 may operate in two directions. The first direction has been disclosed above wherein the hydraulic fluid flowing into the manifold member 12 through the inlet orifice 13 and then out of the manifold through the outlet orifice 15. The second direction may be accomplished by reversing the flow of the hydraulic fluid, wherein the outlet orifice 15 now becomes the input and the input orifice 13 becomes the output, thereby operating the vibration generating member 30 in the opposite direction.

In further embodiments, the inlet orifice 13 may comprise a reduce diameter portion 17 extends between the inlet orifice 13 the inner volume 14 of the manifold member 12. This reduction of diameter may operate to increase the pressure of the hydraulic fluid engaging the vibration generating member 30.

The manifold member 12 comprises a protrusion 16 extending from each side and adjacent to the aperture forming a portion of the inner volume 14. The protrusion 16 may operate to extend within a recess 40 of the bearing retaining plate 20 when the bearing retaining plate 20 is coupled to the manifold member 12.

The manifold member 12 may have various apertures and recesses that are utilized to couple the bearing retaining plate 20 to the manifold member and for use of couplers to couple the manifold member 12 to an external device to vibrate. While these apertures and recesses are shown, they are only for exemplary purposes and should not be considered a limitation, but simply as one way that certain components of a hydraulic vibration generating device 10 may be coupled together. Other forms of coupling components together are contemplated and may be used with departing from the scope of the invention and claims. Further, the manifold member 12 is depicted as a unitary body member. It will be understood that the manifold member 12 may comprise at least two portions that may be coupled together to form the manifold member 12.

Figure 8:
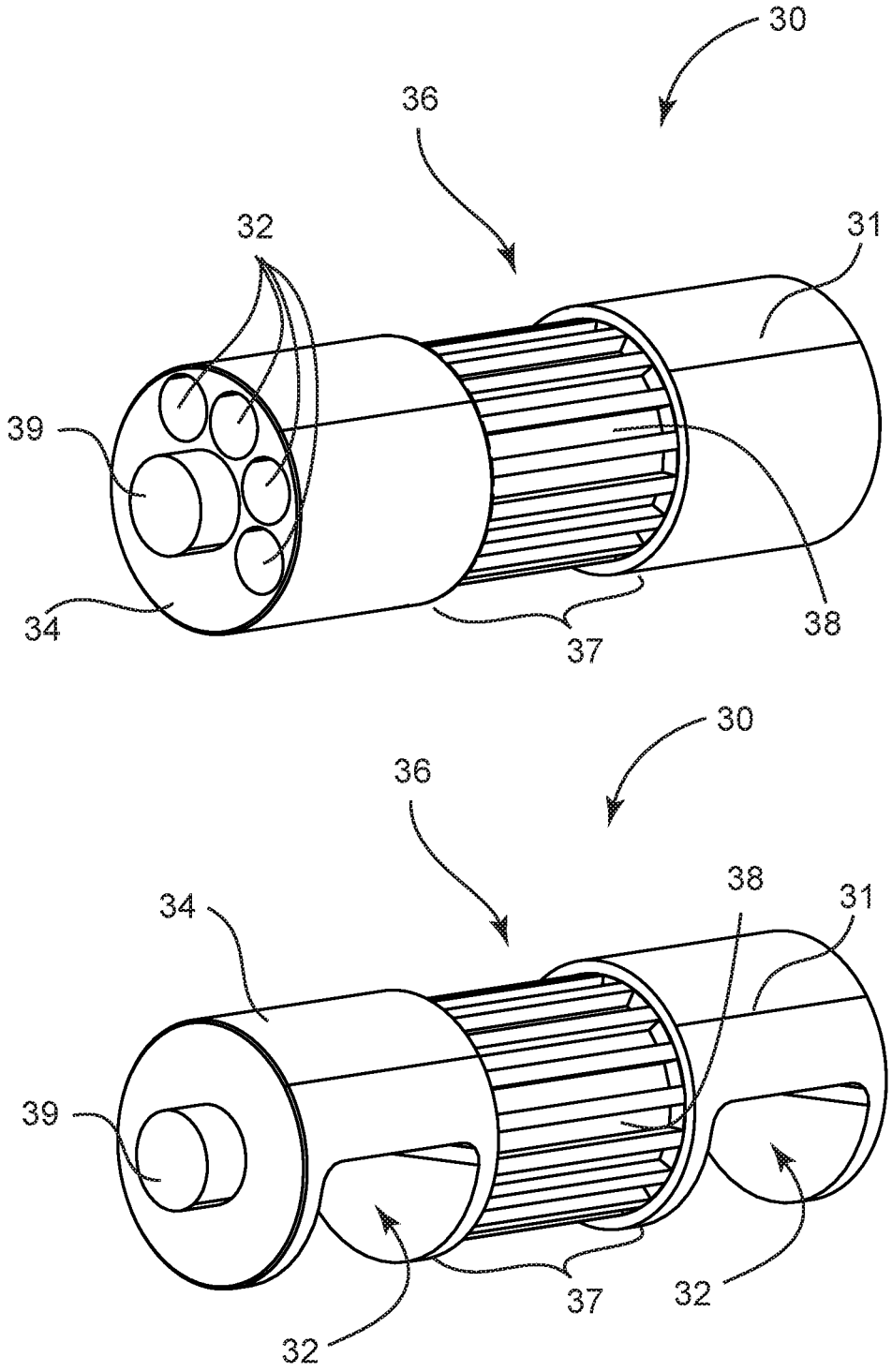
FIG. 8 is a perspective view of an alternative vibration generating member of a hydraulic vibration generating device according to an embodiment.

The vibration generating member 30 may comprise a shaft 31 having voids 32 formed or cut into a portion or portions of the shaft. The voids 32 reduce weight on one side of the shaft 31 thereby creating a weighted side 34 of the shaft, wherein the center of gravity is offset from the axis and is located toward the weighted side of the shaft 31 and not on the axis of the shaft, thereby making the weight "off-center". The shaft 31 of the vibration generating member 30 is rotatable within the inner volume 14 of the manifold member 12. The rotation of the shaft 31 with the off-center weight or offset center of gravity results in vibration of the manifold member 12. As shown in FIG. 8, the voids 32 may comprise channels formed in the shaft 31 or may comprise recesses formed in the shaft 31 or any other void formed to offset the center of gravity to form and off-center weight.

The vibration generating member 30 comprises a channel grooved drive 36 formed in the outer surface of the shaft 31 around a circumference of the shaft 31. The channel grooved drive 36 comprises a channel 37 formed in the outer surface of the shaft 31 around a circumference of the shaft 31. A plurality of grooves 38 are formed in the channel 37, wherein the grooves 38 extend along a width of the channel 37 and are evenly spaced around the circumference of the shaft 31, such that hydraulic fluid may engage the grooves to rotate the shaft 31. The grooves 38 are shown as recesses formed in the shaft 31, however, it is understood that other types of fluid engaging surfaces 36 may comprise, without limitation, recesses, fins, protrusions and the like, wherein the fluid engaging surfaces 36 operate to rotate the vibration generating member 30 as fluid flowing from the inlet orifice 13 of the manifold member and apply force to the fluid engaging surface 36 causing a partial rotation and extends an adjacent fluid engaging surface 36 within the stream of hydraulic fluid entering through inlet orifice 13 to continuously rotate the shaft during flow of hydraulic fluid into the manifold member 12.

In another embodiment (not shown), the vibration generating member 30 may comprise a shaft 31 and a drive shaft (not shown) having the channel grooved drive 36 formed in an outer surface of the drive shaft around a circumference of the drive shaft, wherein the drive shaft is coupled to the shaft 31 of the vibration generating member 30. The channel grooved drive 36 may comprise a channel 37 formed in the outer surface of the drive shaft around a circumference of the drive shaft. The channel 37 of the channel grooved drive 36 may comprise a plurality of grooves 38 formed in the channel 37, wherein the plurality of grooves 38 extends along a width of the channel 37 and are evenly spaced around the circumference of the drive shaft.

It should also be understood that while the figures depict the channel grooved drive 36 located centrally along the length of the vibration generating member 30, the channel grooved drive 36 may be located anywhere along the length of the vibration generating member 30.

The channel grooved drive 36 may further operate to allow the operation of the vibration generating member 30 even if the hydraulic fluid is not at operating temperature. Further, the channel 37 allows hydraulic fluid from the inlet orifice 13 to flow along the channel 37 and exit through the outlet orifice 15, thereby heating the hydraulic fluid and bringing it to operation temperature quicker.

Each bearing retaining plate 20 may comprise a recess 40 for receiving a protrusion 16 of the manifold member 12 and for receiving and retaining the bearings 50. In some embodiments, the recess 40 may be a countersunk recess, wherein there is a lip or step for engaging the protrusion 16 and a deeper recess for receiving the bearing 50 (see FIG. 7). Additionally, the bearing retaining plate 20 may comprise a channel 42 surrounding the recess 40, wherein the channel 42 operates to receive a sealing member 18, wherein the sealing member is retained within the channel 42 when the bearing retaining plate 30 is coupled to the manifold member 12. The sealing member 18 may be formed of deformable material, such as, but not limited to rubber, wherein the sealing member 18 may be compressed between the bearing retaining plate 20 and the manifold member 12 within the channel 42 when the bearing retaining plate 20 is coupled to the manifold member 12 by use of bolts 46. This operates to inhibit the leaking of hydraulic fluid from within the manifold member 12.

In operation of the hydraulic vibration generating device 10, the vibration generating member 30 is coupled within the manifold member 12 by inserting vibration generating member 30 within the inner volume 14 of the manifold member 12. Bearings 50 are coupled to each end of the vibration generating member 30 by inserting protrusions 39 within the bearings 50. The bearings 50 may then be friction fit within recesses 40 of the bearing retaining plates 20. The bearing retaining plates 20 are coupled to the manifold member 12 to retain the vibration generating member 30 and the bearings 50 within the manifold member 12. The channel grooved drive 36 is aligned with the inlet orifice 13 of the manifold member 12. Hydraulic fluid is pumped into the inlet orifice 13 of the manifold member 12 and engages the channel grooved drive 36 to rotate the vibration generating member 30. The off-center weight of the vibration generating member 30 results in vibration of the device 10 caused by a throw action of the rotation of the off-center weight of the vibration generating member 30. The hydraulic fluid pumped into the manifold member 12 has a dual function. The first function is to rotate the vibration generating member 30. The second function is to provide lubrication of the vibration generating member 30 as it rotates within the manifold member 12. Additionally, since the bearing retaining plate 20 seals the hydraulic fluid within the manifold member 12, the flow of fluid through the inlet orifice 13 and out the outlet orifice 15 operates to flush the system and maintain the lubrication, requiring little to no maintenance by eliminating contaminates from entering and remaining in the manifold member 12. Additionally, with little to no load on the vibration generating member 30, friction is reduced because it is simply the rotation of the vibration generating member 30.

The hydraulic vibration generating device 10 is capable of operating at high pressures. For instance, the hydraulic vibration generating device 10 may operate in a fluid pressure range of 0-6000 psi. The size of the channel grooved drive 36 functions to determine the amount of pressure and the volume and rate of hydraulic fluid that is needed to flow into hydraulic vibration generating device 10 in order to rotate the vibration generation member 30. In other words, the depth of the channel 37 and the depth of the grooves 38 can be adjusted for the amount of fluid flow to thereby govern the amount of flow of a desired gallon per minute rate. Additionally, the inlet orifice 13 can be adjusted in size to adjust the amount of fluid flow. Typically, the larger the shaft 31, the more fluid flow is needed for operation. The larger shaft 31 is typically used when more mass is needed and can be accomplished by increasing the diameter of the shaft 31 or may increasing the length of the shaft 31.

The device 10 may be coupled to external devices using bolts 60 and coupling recesses 62 formed in the manifold 12 in order to supply the desired vibratory effect on the external device. The device 10 may also be scaled to various sizes as needed for the various desired vibration and implementation of the vibration generating device 10.

The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above without departing from the spirit and scope of the forthcoming claims.

The invention claimed is:

1. A hydraulic vibration generation device comprising:

a manifold member comprising an inner volume, a fluid inlet orifice and a fluid outlet orifice;

a vibration generating member comprising a channel grooved drive and an off-center weight, wherein:

the vibration generating member is a cylindrical shaft; and the channel grooved drive comprises:

a channel formed in an outer surface of the shaft around a circumference of the shaft the channel forming a bottom surface having a circumference less than the circumference of the shaft, the channel forming a lip on either side of the bottom surface and extending transverse from the bottom surface of the channel to the outer surface of the shaft, the bottom surface having a constant width; and a plurality of recessed grooves formed in the bottom surface of the channel, wherein each recessed groove of the plurality of recessed grooves extend along the width of the channel and are evenly spaced around the circumference of the channel; and two retaining plates, wherein:

the inner volume receives the vibration generating member within the inner volume;

the retaining plates retain the vibration generating member within the inner volume in response to coupling the retaining plates to opposing ends of the manifold member; and the vibration generating member rotates and generates vibration in response to hydraulic oil flowing into the inner volume of the manifold member through the inlet orifice, wherein the hydraulic oil flows through the channel and a portion of the hydraulic oil engages the plurality of recessed grooves to rotate the vibration generating member, and the hydraulic oil flows out of the inner volume of the manifold member through the outlet orifice.

2. The device of claim 1, wherein the vibration generating member comprises at least one void formed into the shaft to create the off-center weight shaft.

3. The device of claim 1, wherein the manifold member is formed as a unitary member.

4. The device of claim 1, wherein inlet orifice and the outlet orifice of the manifold member is formed in the manifold member at any angle.

5. The device of claim 1, further comprising a sealing member coupled between the retaining plate and the manifold member.

6. The device of claim 1, further comprising two bearings, wherein each bearing is operably coupled within a recess of one of the retaining plates, wherein the retaining plates are coupled to manifold member with bolts.

7. The device of claim 1, wherein the manifold member is configured to couple to an external device for vibrating the external device.

8. The device of claim 1, wherein the vibration generating member is rotatable in one direction in response to flowing the hydraulic oil into the manifold member through the inlet orifice and out the outlet orifice and is rotatable in an opposite direction in response to flowing of the hydraulic oil into the manifold member through the outlet orifice and out the inlet orifice.

* * * * *